United States Patent [19]

Wakayama et al.

[11] Patent Number: 4,575,354

[45] Date of Patent: Mar. 11, 1986

[54] RUNNING TOY

[75] Inventors: Yoichi Wakayama, Tokyo; Hirohisa Sato, Nagareyama; Masumi Terui, Matsudo, all of Japan

[73] Assignee: Takara Co., Ltd., Tokyo, Japan

[21] Appl. No.: 507,706

[22] Filed: Jun. 23, 1983

[30] Foreign Application Priority Data

Jun. 25, 1982 [JP] Japan ..... 57-95387[U]

[51] Int. Cl.[4] ..... A63H 17/00; B62B 9/22; B62D 57/00

[52] U.S. Cl. ..... 446/437; 446/465; 446/95; 180/7.1; 280/47.1

[58] Field of Search ..... 46/207, 208, 209, 211; 180/7.1; 280/28.5, 47.1; 446/409, 431, 436, 437, 457, 465, 469, 471, 289, 290, 396, 447, 461, 440, 95, 94, 93, 85, 88

[56] References Cited

U.S. PATENT DOCUMENTS

| | | | |
|---|---|---|---|
| 750,506 | 1/1904 | Wells | 446/270 |
| 1,449,043 | 3/1923 | Henderson | 446/290 |
| 1,592,380 | 7/1926 | Miller | 446/290 |
| 1,681,666 | 8/1928 | Higgins | 446/272 |
| 2,668,391 | 2/1954 | Huard | 46/211 X |
| 2,786,540 | 3/1957 | Sfredda | 180/24.08 |
| 2,790,503 | 4/1957 | Kopczynski | 446/465 X |
| 2,885,823 | 5/1959 | Smith | 446/288 X |
| 2,942,376 | 6/1960 | Short | 446/292 |
| 3,263,363 | 8/1966 | Doe | 446/465 |
| 3,600,851 | 8/1971 | Nielson | 446/436 |
| 3,646,706 | 3/1972 | Adickes | 446/465 |
| 3,712,359 | 1/1973 | Williams | 446/440 X |
| 4,275,524 | 6/1981 | Gabriel | 446/85 |
| 4,277,909 | 7/1981 | Rainwater | 446/289 |

*Primary Examiner*—Robert A. Hafer
*Assistant Examiner*—D. Neal Muir
*Attorney, Agent, or Firm*—Price, Gess & Ubell

[57] ABSTRACT

A running toy has a detachable non-circular wheel attached to an axle driven by a known prime mover, such as spring-powered prime mover and the like. The wheel is molded from an elastic material, such as rubber, soft plastic and the like, and has large projections and recesses formed on the peripheral surface thereof to make the running toy perform various interesting motions which are not conventionally obtained as well as to offer favorable effects.

8 Claims, 7 Drawing Figures

RUNNING TOY

BACKGROUND OF THE INVENTION

The present invention relates to a running toy and more particularly to a running toy improved to perform various interesting motions.

Hitherto, numerous forms of toy cars that are self-propelled have been provided by the toy industry. The industry, however, demands a continued infusion of new toy concepts and is still receptive to new and novel toy vehicle designs to entertain and elicit the interest of children.

SUMMARY OF THE INVENTION

A primary object of the invention is to provide a running toy wherein wheels are adapted to be detachable from an axle thereof driven by a known prime mover, such as a spring-powered prime mover and the like, and moreover, the wheels attached to the axle are made non-circular. This construction offers the following advantages: variety is given to the running mode and course of the toy; the toy is provided with a governor function; the toy is made able to get over an obstacle; and any racing of the wheels is eliminated at its initial starting.

The above and other objects, features and advantages of the invention will become apparent from the following description taken in connection with the accompanying drawings.

BRIEF DESCRIPTION OF THE DRAWINGS

The accompanying drawings show embodiments of the invention, in which.

DESCRIPTION OF THE PREFERRED EMBODIMENTS

The invention will be described hereinunder in detail through an illustrated embodiment.

Figure 1:
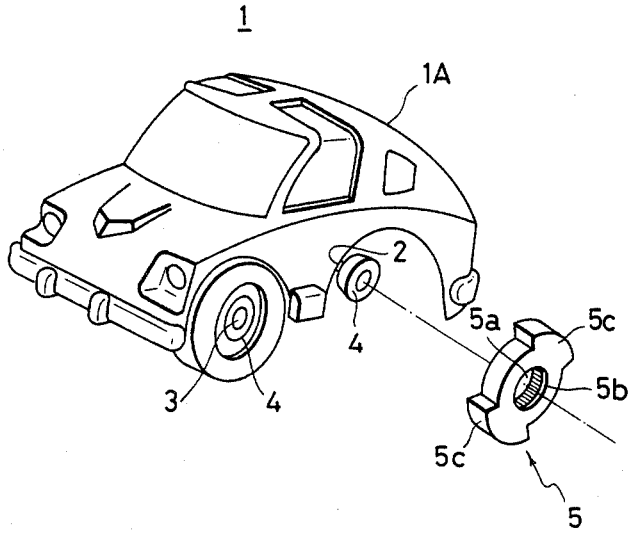
FIG. 1 is a perspective view of a running toy for describing an embodiment of the invention.

Referring first to FIG. 1, a running toy 1 in accordance with the invention has a driving axle 2 on the rear wheel side and a driven axle 3 on the front wheel side. The driving axle 2 is adapted to be rotated by a known spring-powered prime mover, motor or the like (not shown) accomodated in a housing 1A of the running toy 1.

Figure 2:
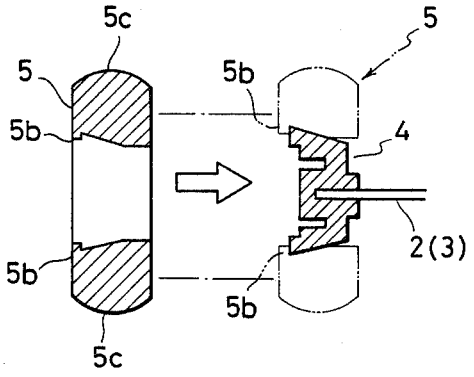
FIG. 2 is a sectional view of a wheel of the running toy shown in FIG. 1, for describing how the wheel is attached to an axle of the running toy.

To each of the ends of the driving and driven wheels 2, 3, a hub 4 is secured which has a truncated cone shape with a slight taper as shown in FIG. 2. The truncated cone-shaped hub 4 is formed so that the outer end side thereof has a larger diameter.

A wheel, such as a tire, is detachably mounted on each hub 4. The tire is an irregularly shaped tire having either of such various shapes as shown in infra FIG. 3.

Figure 3:
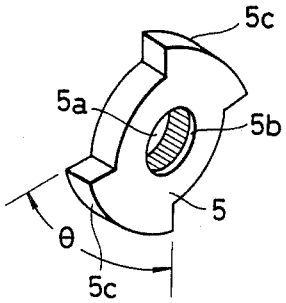
FIGS. 3 to 7 are perspective views for describing other examples of the wheel shown in FIG. 2, respectively.

A tire 5 shown in FIG. 3 has a through hole 5*a* in its central portion. The through hole 5*a*, as shown in the figure, has a section of a truncated cone shape with a slight taper corresponding to the sectional configuration of the hub 4. In addition, an elongated protrusion 5*b* is formed along the peripheral surface of the through hole 5*a* on the larger-diameter side so as to project toward the center thereof. The protrusion 5*b* is adapted to function as a stopper used when the tire 5 is secured to the hub 4.

Fan-shaped expanded portions 5*c* are projected from symmetrical positions on the outer peripheral surface of the tire 5 so as to each extend over a predetermined angular range. The angular range $\theta$ over which each of the expanded portions 5*c* is formed is 90° degrees, for example.

Figure 4:
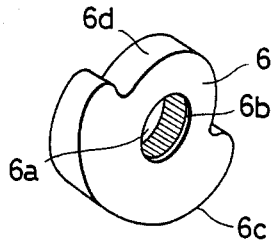

A wheel 6 shown in FIG. 4 has a larger-diameter portion 6*c* and a smaller-diameter portion 6*d* each of which is formed on the outer peripheral surface thereof over an angular range of 180 degrees, as well as a through hole 6*a* and an elongated protrusion 6*b* which are formed in the central portion thereof so as to be equal in shape to those of the tire 5.

Figure 5:
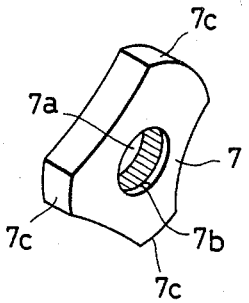

A tire 7 shown in FIG. 5 similarly has a through hole 7*a* and an elongated protrusion 7*b* and is formed to have a substantially triangular shape as a whole. A circular arc portion 7*c* is formed on each of the apexes of the triangular tire 7.

Figure 6:
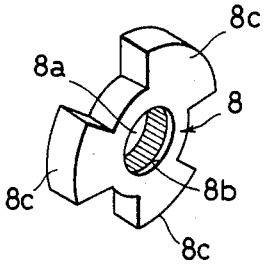

A tire 8 shown in FIG. 6 similarly has a through hole 8*a* and an elongated protrusion 8*b* and is provided with three fan-shaped expanded portions 8*c* which are formed on the outer peripheral surface thereof so as to be equally spaced circumferentially thereof.

Figure 7:
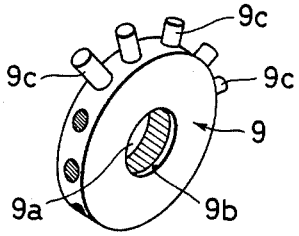

A tire 9 shown in FIG. 7 similarly has a through hole 9*a* and an elongated protrusion 9*b* and is provided with a plurality of projections 9*c* formed on the outer peripheral surface thereof at a predetermined pitch. These projections 9*c* are adapted to be able to be torn off with fingers or cut off with a knife or the like.

The deformed tires or wheels shown in FIGS. 3 to 7 are molded from an elastic material such as rubber, soft plastic and the like. It is to be noted that these tires or wheels are only some examples of deformed tires applicable to the invention. Any tire may be employed that has a tire configuration where the overall shape of the side surface thereof is non-circular, i.e., the peripheral surface of the tire has large projections and recesses different from tread patterns.

Such various deformed tires are prepared, and they are attached to the hubs 4 of the driving axle 2 or driven axle 3 by the use of elasticity thereof, in one of various combinations, such as combination of tires or the same kind or combination of tires of different kinds, according to the desired playing mode of the running toy.

When the tire 5 shown in FIG. 3 is employed, for example, the following operation and function are offered.

Namely, in the case where the tires 5 are attached to the hubs 4, 4 of the driving axle 2 as shown in FIG. 1, since each tire 5 has the expanded portions 5*c*, 5*c*, there is provided a difference between the distance defined between the axis of the driving axle 2 and each expanded portion 5*c* when the same is grounded on one hand and the distance defined between the axis of the driving axle 2 and a portion other than the expanded portions 5*c* when the same is grounded on the other. Accordingly, the same torque transmitted provides turning moments different in magnitude from each other, resulting in a non-uniformity of the running state, as well as causing the driving wheel side of the running toy to move up and down. This vertical motion will take place simultaneously on the right and left in the case where the tires 5 are attached to the hubs 4, 4 of the driving axle 2 so as to be equal in phase to each other. On the other hand, when the tires 5 are attached so as to be out of phase with each other, extremely varied vertical motions will take place alternately on the right and left ends of the driving axle 2. As a result, the running toy performs a traveling as if the same were walking.

Although a large change is offered by only this traveling motion, if the tires 5 are also attached to the hubs 4, 4 of the driven axle 3, a further complicated motion can be expected.

Such a complicated motion is also obtained by employing the other deformed tires 6 to 9, and the running toy can be made to perform a much more complicated motion through a selected combination of these tires.

Above all, the tire 9 shown in FIG. 7 advantageously allows the player to select a desired motion since the projections 9*c* can be cut off at will.

By the way, when a portion other than the curved portions of each of the deformed tires 5 to 9 is grounded, a large torque is required to rotate the tire. Therefore, if that portion is grounded at starting, a stopper effect is offered to hold the running toy as it is under the state where the toy is left with the spring wound and without any extra force applied thereto. The toy starts to travel when the housing 1A is slightly pushed with a finger.

Moreover, because of an intermittent motion, the force derived from the spring is not abruptly released, i.e., a governor effect is offered. Accordingly, it is possible to make the running toy travel over a long period of time.

Further, when the deformed tires are employed as either driving wheels or driven wheels, the driving wheels are prevented from racing. As a result, the running toy is provided with a function similar to a four-wheel drive so that the toy can get over an obstacle having a size to some extent.

As will be fully understood from the foregoing description, the running toy in accordance with the invention has detachable non-circular wheels molded from an elastic material, such as rubber, soft plastic and the like, and deformed to have projections and receses formed on their outer peripheral surfaces. Therefore, it is possible to make the running toy perform a vertical motion, course change or walking by attaching these wheels thereto through a desired combination of the wheels of the same kind or the wheels of different kinds. In addition, the toy is provided with a stopper function at starting, and a governor effect is offered. Moreover, the toy can get over obstacles. Thus, it is possible to provide a running toy improved to perform various motions which are not conventionally obtained.

Although the invention has been described through specific terms, it is to be noted here that the described embodiments are not exclusive and various changes and modifications may be imparted thereto without departing from the scope of the invention which is limited solely by the appended claim.

What is claimed is:

1. In combination with a toy car having a self-contained power source for driving an axle, the improvement comprising:

a tire of a non-circular configuration mounted on the axle for contacting a support surface during translational movement of the toy car, the tire is formed of a base of cylindrical solid material having a central bore, the bore including a conical configuration terminating with an annular retaining protrusion, a fan shaped portion extending radially outwardly from the base having a circumferential section having a larger radius than the remainder of the base circumference over an angular range of at least 180 degrees, the connecting surfaces on either side of the fan shaped portion extend radially outwardly from the base to create a step shaped interface.

2. The invention of claim 1 wherein the tire is removably attached to the axle and formed of a molded flexible material.

3. The invention of claim 2 wherein the tire circumference is divided into a first portion of a large radius and a second portion of a small radius.

4. In combination with a toy car having a self-contained power source for driving an axle, the improvement comprising:

a tire of a non-circular configuration mounted on the axle for contacting a support surface during translational movement of the toy car, the tire is formed of a base of cylindrical solid material having a central bore and has a plurality of fan shaped portions equally spaced about its circumference, the side edges of the fan shaped portions extending radially outwardly from the base of cylindrical solid material.

5. The invention of claim 4 wherein the bore includes a conical configuration terminating with an annular retaining protrusion.

6. The invention of claim 4 wherein the tire is removably attached to the axle and formed of a molded flexible material.

7. In combination with a toy car having a self-contained power source for driving an axle, the improvement comprising:

a tire of a circular perimeter configuration having a circumferential surface and mounted on the axle for contacting a support surface during translational movement of the toy car, the tire is formed of a solid material having a central bore and includes a plurality of equally spaced individual cylindrical radial projections of the same length, at least a portion of the projections being subjectively removed to provide a desired tire configuration such that a portion of the circumferential surface is devoid of the radial projections providing a gap substantially greater than the spacing between the individual radial projections.

8. The invention of claim 7 wherein the bore includes a conical configuration terminating with an annular retaining protrusion and the tire is removably attached to the axle.

* * * * *